United States Patent [19]

Koo

[11] Patent Number: 4,754,550

[45] Date of Patent: Jul. 5, 1988

[54] CAN OPENERS

[75] Inventor: Hong W. V. Koo, Kowloon, Hong Kong

[73] Assignee: Mike & Kremmel, Ltd., Hong Kong

[21] Appl. No.: 822,434

[22] Filed: Jan. 27, 1986

[51] Int. Cl.[4] ..... B67B 7/72

[52] U.S. Cl. ..... 30/417; 30/426

[58] Field of Search ..... 30/417, 418, 426, 416; 81/415; 16/112; 7/127

[56] References Cited

U.S. PATENT DOCUMENTS

| | | | |
|---|---|---|---|
| 1,599,765 | 9/1926 | Hoffman | 30/417 |
| 1,698,605 | 1/1929 | Newkirk . | |
| 2,606,363 | 8/1952 | Hartman et al. . | |
| 2,804,682 | 7/1957 | Landry . | |
| 3,583,264 | 6/1971 | Brunosson | 81/415 |
| 4,563,818 | 1/1986 | Kreth | 30/417 |

FOREIGN PATENT DOCUMENTS

| | | |
|---|---|---|
| 126819 | 11/1926 | Canada . |
| 2478058 | 9/1981 | France . |
| 66361 | 10/1972 | Luxembourg . |
| 1328177 | 8/1973 | United Kingdom . |
| 2118134A | 10/1983 | United Kingdom . |

*Primary Examiner*—E. R. Kazenske
*Assistant Examiner*—Michael D. Folkerts
*Attorney, Agent, or Firm*—Townsend and Townsend

[57] ABSTRACT

A can opener providing a circular cut around the cylindrical wall of a can below the lid and rim which are severed by the cut from the rest of the can. A pair of body members having integrally formed handles are pivoted to one another. A rotatable spindle attached to a driving wheel drives the can opener. A cutting wheel forms a nip with the driving wheel in an operating position to force the cutting edge to penetrate through the wall of the can. A mounting plate carrying the cutting wheel is slidably supported by one body member and is movable by cam means between the operating position and a retracted position as the body members are pivoted between their limits of pivoting. To prevent twisting of the body members and their integral handles, cooperating flanges and recess are provided between the body members and their handles. In the retracted position the wheel withdraws into an upstanding guard whose edge abuts the severed top and displaces it.

16 Claims, 4 Drawing Sheets

CAN OPENERS

BACKGROUND TO THE INVENTION

Although many different designs of can openers are known, very few work really satisfactorily. In many instances, the cutting edge is liable to become jammed and a ragged cut given which can be dangerous to the user. Also small filings of metal may be generated which contaminate the contents of the can.

Our co-pending European patent application No. 84304750.7 describes a hand-held can opener intended to provide a cut around the wall of the can below the lid and rim which are severed by the cut from the rest of the can, the can opener comprising a pair of body members pivotally joined to one another, each body member having an integrally-formed handle extending generally away from the point of pivoting and movable between a more open position and a more closed position, the handles being intended to be grasped by one hand of the user in the more closed position, a spindle to which is attached a driving wheel to be brought into contact with the lip of the lid of a can, the spindle being manually rotatable to cause the driving wheel to orbit the can opener relatively around the top of the can, a cutting wheel which, in an operating cutting position, forms a nip with the driving wheel so that the cutting edge of the cutting wheel is forced to penetrate through the wall of the can and provide a cut around the can as the opener orbits relatively around the can, a mounting plate slidably supported by one of the body members and on which the cutting wheel is rotatably mounted, the sliding plate being movable between the operating cutting position where the driving wheel forces the cutting edge to penetrate the can wall and an inoperative position where the cutting wheel is moved, e.g. substantially radically relative the axis of rotation of the cutting wheel, away from the cutting wheel, and cam means for moving the plate and the supported cutting wheel to the cutting position as the handles are pivoted towards the more closed position and moving it away to its inoperative position when the handles are pivoted away from that said limit of pivoting towards the more open position.

Such a can opener has been found to give a good clean cut without ragged edges and substantially without the formation of dangerous metal filings. In addition, the can opener can usually operate successfully even if the can is quite seriously damaged and dented. Further the can opener will work both on conventional cylindrical shaped tins and on tins of other shapes, e.g. oval or square.

We have however encountered a problem with such a can opener in that when opening cans which are particularly tough the two handles may twist relative one another and cause the body members to open up sufficiently for the cam means and the sliding plate to become disengaged. It is therefore an object of the present invention to eliminate this possibility.

BRIEF SUMMARY OF THE INVENTION

According to the present invention there is provided a hand-held can opener as described above in which between each handle and the other body member are provided cooperating flanges and recesses such that the engagement of one flange in the cooperating recess reinforces the overall can opener and prevents twisting of the handles relative one another when under a can opening load.

An advantage of the uses of the cooperating flanges and recesses seems to be that, because any twisting of the handles and operating parts, the desired tolerances between the cutting wheel and driving wheel are maintained even under high loads.

It is preferred that the edges of each handle where it abuts the other body member be provided with a recess into which a corresponding arc-shaped flange fits. In this way the recess traps the flange in the twisting sense and so strengthens and reinforces the overall can opener but at the same time does not in any way restrict the opening and closing of the handles.

Preferably the axis of the manually rotatable spindle on which the driving wheel is mounted coincides with the axis of pivoting of the two body members.

The cam means bring the cutting wheel to its operative cutting position upon quite small angular pivoting movement of the body portions, e.g. a maximum opening of 30°. Thus the pivoting of the body members can be limited in extent. This has advantages over, for example, the can opener described in our co-pending United Kingdom application No. 8303320, publication No. 2118134, where it is necessary to pivot the handles over about 180° in order to open up the cutting nip between the driving wheel and the cutting wheel.

The cam means can comprise a slot, e.g. a substantially straight slot, inclined at an angle to the axis of sliding of the mounting plate and formed in the other body member, i.e. the one which does not slidably support the mounting plate, and a pin projecting from the mounting plate into that slot, although the positioning of the slot and pin could be reversed. The slot is preferably angled at around 15° to the direction of the sliding of the plate in the more closed position of the handles but this angle could, for example, vary from 10° to 30°. In fact by forming the slot on the said other body member, the relative angle of the slot to the direction of sliding of the plate will vary as the handles move between their more closed position and their more open position. Thus the angle will become larger as the handles move from the more closed position to the more open position and the mechanical advantage will also vary. This has the advantage that as the handles are closed from their more open position, the plate will advance the cutter wheel relatively rapidly initially but as the cutter wheel approaches the can, it will advance more slowly and a relatively larger force exerted to penetrate the can wall.

Preferably an upstanding guard is integrally formed on the said other body member, the guard protecting the user from accidentally touching the cutting wheel.

Preferably there is a abutment upstanding from the said other body member which acts to eject or release a severed can lid from the nip between the cutting wheel and the driving wheel as the cutting wheel moves to its inoperative position. This could be an edge inclined to the direction of movement of the cutting wheel between its operative and inoperative positions, that edge being, for example, constituted by the ends of the upstanding guard. Alternatively the knife could retract into a pouch whose open edge constitutes that said edge.

The driving wheel and the spindle to which it is connected can be manually driven, e.g. by means of a two-armed crank attached to the free end of the spindle. Alternatively, the can opener could be a hand-held electric can opener and the spindle could be motor driven with one of the handles including additionally a housing for the electric motor.

BRIEF DESCRIPTION OF THE DRAWINGS

A can opener according to the invention will now be described, by way of example, with reference to the accompanying drawings, in which.

DESCRIPTION OF THE PREFERRED EMBODIMENT

Figure 3:
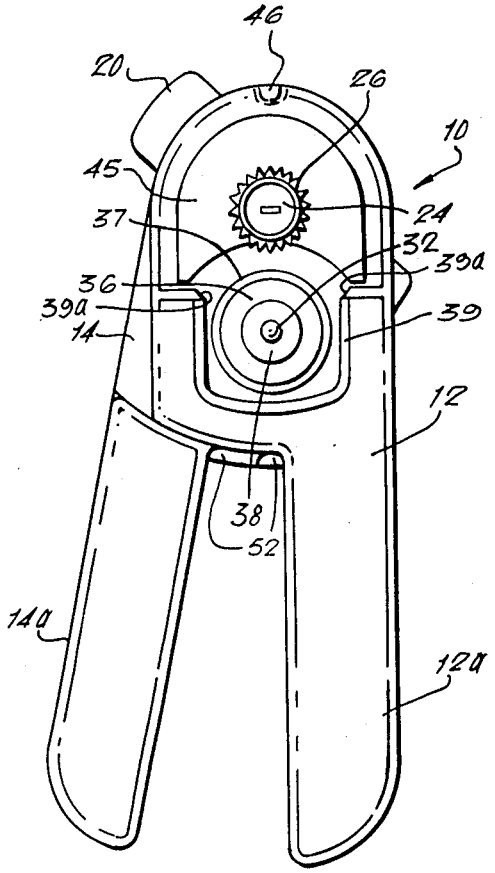
FIG. 3 is a view similar to FIG. 1 but with the can opener in its open non-operative position.
Figure 4:
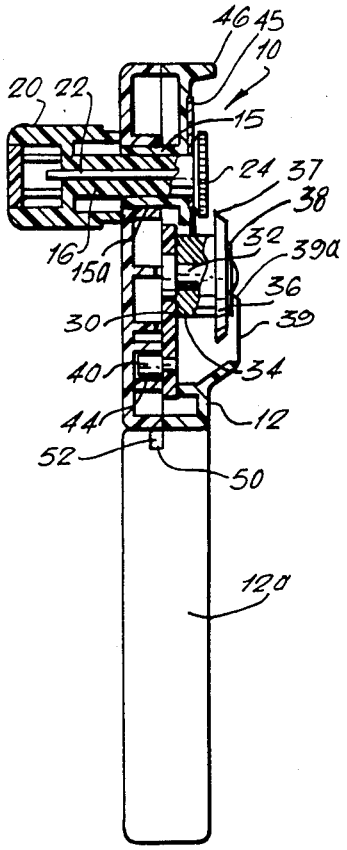
FIG. 4 is a section taken on the line 4—4 of FIG. 1.

The can opener 10 shown in the drawings includes two body portions 12 and 14. The two portions are pivoted to one another about a circular upstanding hollow spigot 15 on the portion 12 which extends into a circular hole 15*a* on the portion 14. Extending axially through the spigot 15 and hole 15*a* is a spindle 16 (FIG. 4). The body portions are therefore pivotable between a closed working position shown in FIG. 1 and an open position shown in FIG. 3.

Figure 1:
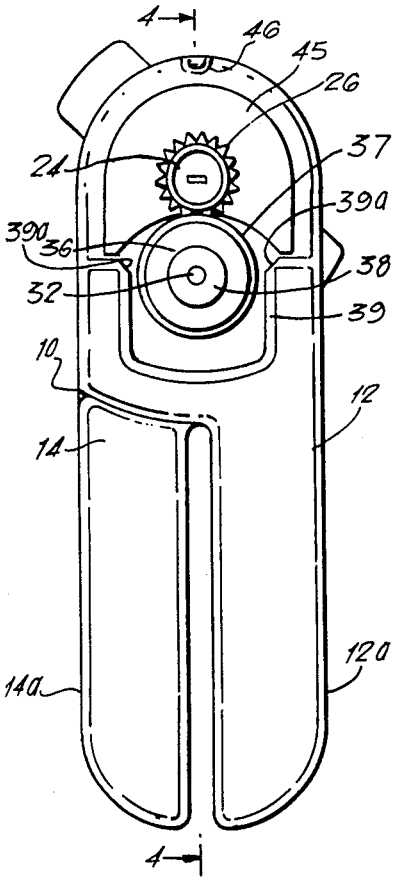
FIG. 1 is a front view of a can opener according to the invention shown in its closed operative position.
Figure 2:
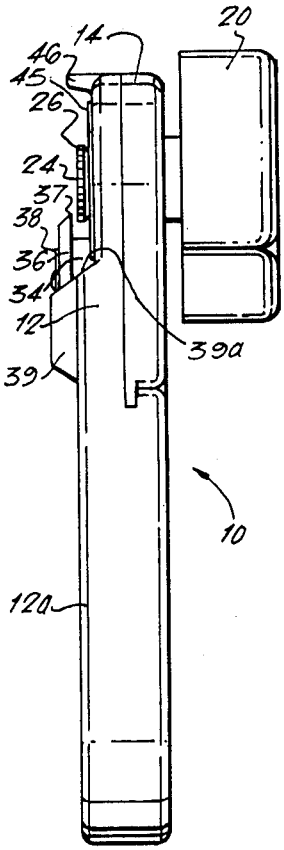
FIG. 2 is a side view of the can opener shown in FIG. 1.
Figure 7:
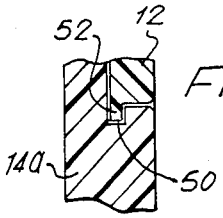
FIG. 7 is an enlarged sectional detail taken along the line 7—7 of FIG. 1.

The body portions 12 and 14 each include an integral handle 12*a* and 14*a*, respectively, extending generally away from the axis of the spindle 16 such that they lay closely alongside and parallel to one another in the closed position shown in FIG. 1. Conveniently the two body portions are moulded from synthetic plastics material, e.g. polypropylene.

Integrally formed at one end of the spindle is a two-armed crank 20 for use in manually rotating it. Axially embedded in the spindle is a metal reinforcing shaft 22, one end of which latter extends slightly beyond the end of the spindle 16 and is attached to a driving wheel 24. The latter is dish-shaped and has an outer toothed edge 26 capable of frictionally engaging the lip 28 of the lid 27 of a can 29 (FIG. 6) and driving the can opener around the can during opening.

Figure 5:
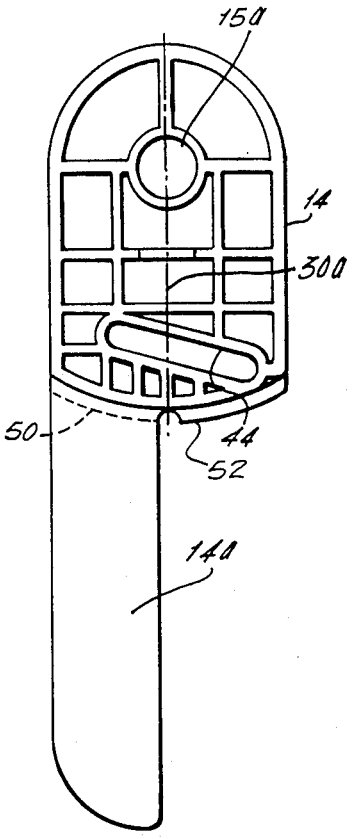
FIG. 5 is an elevation of one of the body members shown separately from the rest of the can opener.

Slidably mounted in the body portion 12 is a rectangular metal plate 30 constrained to move along an axis 30*a* (see FIG. 5). Extending outwardly from one face of the plate is a pin 32 on which is rotatably mounted a sleeve 34 of synthetic plastics material. Rotatably connected to the sleeve and positioned outwardly of it is a metal cutting wheel 36 having a pointed circular cutting edge 37. The sleeve 34 is intended to bear against the lip of the can and be rotated as the can opener advances around the can, the cutting wheel 36 being rotated at the same time because of its rotatable connection with the sleeve. A washer 38*a* is positioned outside the cutting wheels, and the sleeve 34, wheel 36 and washer 38 are held in place by the riveting over of the end of the pin 32.

Integrally formed with the body portion 12 is an upstanding U-shaped guard 39. This shields the cutting wheel to prevent the user from accidentally cutting himself. The guard 39 has at its ends edges 39*a* which are inclined to the axis 30*a*. At the end of a can opening operation the severed lid is trapped and held between the cutting wheel 36 and driving wheel 24. Therefore, as the cutting wheel is withdrawn after a can has been opened, the lid of the can will abut these edges 39*a* and be forced from beneath the edge of the cutting wheel 36 and so automatically released for disposal.

Projecting from the opposite face of the plate 30 is a cam pin 40. This engages in a slot 44 formed in the body portion 14. The slot is substantially straight and inclined at about 15° to the axis 30*a* in the closed position of the handles so that, as the handles 12*a* and 14*a* are moved between the open position shown in FIG. 3 and the closed position shown in FIG. 1, the plate 30 is cammed from a lower position to an upper operating position shown in FIG. 4. As a result the cutting wheel 36 also moves from its non-operating position shown in FIG. 3 where its cutting edge 37 is spaced sufficiently from the driving wheel 24 for it to fit over the lip 28 of a can 29 to its operating and cutting position shown in FIG. 1 where the cutting edge 37 slightly overlaps the driving wheel 26. If desired the edge 44*a* of the slot which drives the cam pin 40 can be locally reinforced by an embedded metal strip.

Because the slot 44 is formed on the body member 14, the relative angle of the slot to the direction of sliding of the plate 30 will vary as the handles move between their more closed position and their more open position. Thus the angle will become larger as the handles move from the more closed position to the more open position and the mechanical advantage will also vary. This has the advantage that as the handles are closed from their more open position, the plate will advance the cutter wheel relatively rapidly initially but as the cutter wheel approaches the can, it will advance more slowly and a relatively larger force exerted to penetrate the can wall.

At the inner end of each handle 12*a* or 14*a* is provided an arcuate recess 50. A corresponding arcuate shaped flange 52 is integrally formed on each body portion 14 or 12 respectively. The flanges 52 slidably engage in their respective recesses 50 and their arcuate shape allows the handles to open and close without hindrance. The engagement of the flanges 52 in their respective recesses 50 does however prevent twisting of the handles 12*a* and 14*a* when under excessive loads which might cause the body members to open sufficiently for the cam pin 40 to become disengaged from the slot 44. When the handles are in open position only a relatively short portion of each flange 52 is engaged in its respective recess 50 but at such times the twisting forces are unlikely to be large. However as the handles progressively close and once they are completely closed, the recesses engage a progressively longer length of the flange and so are capable of resisting the resulting larger forces which may be encountered during the opening of a can.

Figure 6:
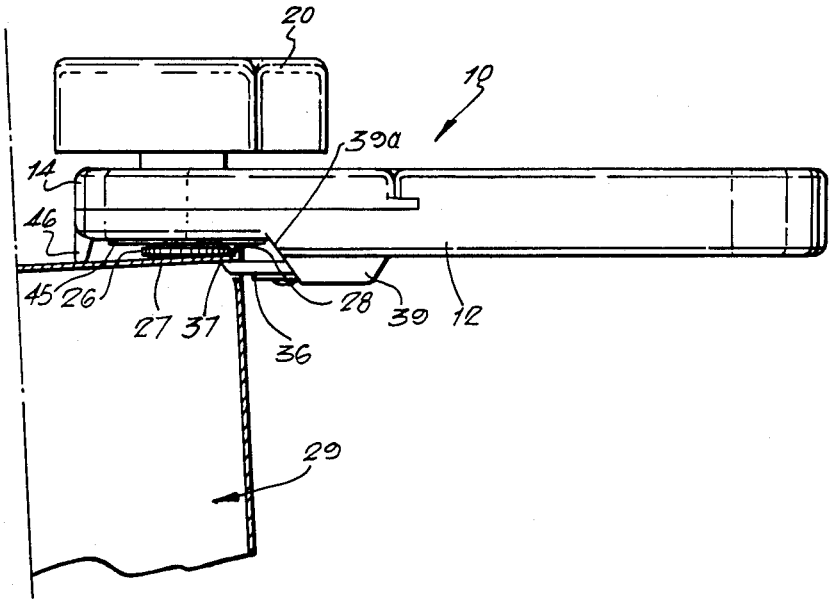
FIG. 6 is a view showing the can opener in use in opening a can.

This cutting position is also shown in FIG. 6 and the cutting edge 37 is there shown as penetrating the top edge of the cylindrical wall of the can just beneath the lid 27. Therefore, upon rotation of the crank 20, the can opener 10 is driven in a circular orbit around the top of the can in the case of a cylindrical can and a circular cut is made in the cylindrical wall of the can near its top. Once a circular cut is complete, the top of the can can be lifted cleanly off and is held trapped between the cutting wheel 36 and driving wheel 24 until the handles are brought into the open position shown in FIG. 3 when the top is ejected by contact with the edges 39*a*.

A metal plate 45 is embedded in the face of the body portion 12 to provide protection for the plastic material of that body when it comes into contact with a rim of a can during opening. The surface of the metal plate 45 is slightly prowd relative the body portion 12.

To assist in maintaining the position of the can opener during its cutting, a small lug 46 is integrally formed with the portion 12 and extends generally parallel to the axis of the spindle 16. Its end bears on the top of the lid 27 and keeps the can opener relatively level.

The can opener 10 is simple to make and operate and the can also be kept clean and hygenic.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A can opener intended to provide a cut around the wall of the can below the lid and rim which are severed by the cut from the rest of the can, the can opener comprising a pair of body members, each of said body members including a body portion lying closely alongside the body portion of the other body member and being pivotably joined to one another, each body member having an integrally formed handle extending generally away from the point of pivoting and movable between a more open position and a more closed position, the handles being intended to be grasped by one hand of the user in the more closed position, a driving wheel capable of rotation to engage the rim of the can and to orbit the can opener relatively around the top of the can, a cutting wheel which, in the cutting position, forms a nip with the driving wheel so that the cutting edge of the cutting wheel is forced to penetrate through the wall of the can and provide a cut around the can, said driving wheel and cutting wheel being operatively mounted on a body member, means for advancing and retracting the cutting wheel and driving wheel relative to one another to provide the said nip in the advanced position as the body members pivot relative to one another whereby the wheels advance relatively as the handles move towards the more closed position and retract relatively as the handles move toward the more open position, and a flange projecting from the body portion of each body member into a corresponding recess in the other body member such that the engagement of the flange on each member in the corresponding recess of the other member reinforces the can opener and substantially prevents twisting of the body members and their integral handles relative to one another when under a can opening load.

2. A can opener according to claim 1 in which the edge of the handle of each body member where it abuts the other body member is provided with a frusto-sector shaped recess, and a corresponding frusto-sector shaped flange is provided on the body portion of the other body member and projects into and engages with said frusto-sector shaped recess.

3. A can opener according to claim 1 in which the axis of rotation of the driving wheel coincides with the axis of pivoting of the two body members.

4. A can opener according to claim 1 in which the means for advancing and retracting the cutting wheel and driving wheel includes a mounting plate slidably supported by a one first body on the members and on which the cutting wheel is rotatably mounted and cam means for advancing and retracting the plate and supported cutting wheel as the body members pivot.

5. A can opener according to claim 4 in which the cam means includes a slot inclined at an angle to the axis of sliding of the mounting plate, and a pin projecting into that slot, the pin and slot being positioned between the mounting plate and a second one body of the members, i.e., the one which does not slidably support the mounting plate.

6. A can opener according to claim 5 in which the slot is substantially straight and inclined at an angle of 10° to 30° to the direction of sliding of the plate when the handles are in their more closed position.

7. A can opener according to claim 5 in which the slot is formed in the body portion of said second body member and the pin projects from the mounting plate into the slot.

8. A can opener according to claim 1, further comprising an upstanding guard integrally formed on a body portion between the cutting wheel and the handle of the body member to which the cutting wheel is mounted, the guard protecting the user from accidentally touching the cutting wheel.

9. A can opener according to claim 8 in which the end or ends of the guard includes an edge inclined to the direction of retraction of the cutting wheel relative the driving wheel, that inclined edge being positioned to eject a severed can lid from the nip between the cutting wheel and the driving wheel as the cutting wheel retracts relative the driving wheel.

10. A can opener according to claim 1 which comprises an abutment upstanding from a body portion of one of said body members, the abutment being positioned to eject a severed can lid from the nip between the cutting wheel and the driving wheel as the cutting wheel is retracted relative to the drive wheel.

11. A hand-held can opener intended to provide a cut around the wall of a can below the lid and rim which are severed by the cut from the rest of said can, the can opener comprising:

a pair of body members, each of said body members including a body portion lying closely alongside the body portion of the other body member and being pivotally joined to one another, an integrally-formed handle for each body member extending generally away from the point of pivoting and movable between a more open position and a more closed position, said handles being intended to be grasped by one hand of the user in the more closed position, a spindle operatively mounted on a body member, a driving wheel attached to said spindle to be brought into contact with the lip of the lid of a can, means for rotating said spindle to cause said driving wheel to orbit the can opener relatively around the top of the can, a cutting wheel which, in an operating cutting position, forms a nip with said driving wheel so that the cutting edge of said cutting wheel is forced to penetrate through the wall of the can and provide a cut around the can as the opener orbits relatively around the can, a mounting plate slidably supported by one of said body members and on which said cutting wheel is rotatably mounted, the sliding plate being movable between the operating cutting position where the driving wheel forces the cutting edge to penetrate the can wall and an inoperative position where said cutting wheel is moved away from said driving wheel, cam means for moving said plate and said supported cutting wheel to said cutting position as said handles are pivoted towards the said more closed position and moving said plate and said cutting wheel away from said driving wheel to said inoperative position when said handles are pivoted away from said more closed position towards said more open position, said cam means including a substantially straight slot inclined at an angle to the axis of sliding of the mounting plate and formed in the body member, which does not slidably support the mounting plate, and a pin projecting from said mounting plate into the slot, and a flange projecting from the body portion of each body member into a corresponding recess in the other body member such that the engagement of the flange on each member with the corresponding recess in the other member reinforces the can opener and substantially prevents twisting of the body members and their integral handles relative to one another when under a can opening load.

12. A can opener according to claim 11 in which the edge of the handle of each body member where it abuts the other body member is provided with a frusto-sector shaped recess, and a corresponding frusto-sector shaped flange is provided on the body portion of the other body member and projects into and engages with said frusto-sector shaped recess.

13. A hand-held can opener intended to provide a cut around the wall of a can below the lid and rim which are severed by the cut from the rest of said can, the can opener comprising:

a pair of body members, each of said body members including a body portion lying closely alongside the body portion of the other body member and being pivotally joined to one another, an integrally-formed handle for each body member extending generally away from the point of pivoting and movable between a more open position and a more closed position, said handles being intended to be grasped by one hand of the user in the more closed position, a spindle operatively mounted on a body member, a driving wheel attached to said spindle to be brought into contact with the lip of the lid of a can, means for rotating said spindle to cause said driving wheel to orbit the can opener relatively around the top of the can, the axis of the spindle coinciding with the axis of pivoting of the two body members, a cutting wheel which, in an operating cutting position, forms a nip with said driving wheel so that the cutting edge of said cutting wheel is forced to penetrate through the wall of the can and provide a cut around the can as the opener orbits relatively around the can, a mounting plate slidably supported by one of said body members and on which said cutting wheel is rotatably mounted, the sliding plate being movable between the operating cutting position where the driving wheel forces the cutting edge to penetrate the can wall and an inoperative position where said cutting wheel is moved away from said driving wheel, cam means for moving said plate and said supported cutting wheel to said cutting position as said handles are pivoted towards the said more closed position and moving said plate and said cutting wheel away from said driving wheel to said inoperative position when said handles are pivoted away from said more closed position towards said more open position, and a flange projecting from the body portion of each body member into a corresponding recess in the other body member such that the engagement of the flange on each member with the corresponding recess in the other member reinforces the can opener and substantially prevents twisting of the body members and their integral handles relative to one another when under a can opening load.

14. A can opener according to claim 13 in which the edge of the handle of each body member where it abuts the other body member is provided with a frusto-sector shaped recess, and a corresponding frusto-sector shaped flange is provided on the body portion of the other body member and projects into an engages with said frusto-sector shaped recess.

15. A can opener according to claim 13 wherein the flanges are spaced apart from the point of pivoting of the body members.

16. A can opener according to claim 15 wherein the flanges face away from the point of pivoting of the body members.

* * * * *